US006883354B1

(12) United States Patent
Yu

(10) Patent No.: US 6,883,354 B1
(45) Date of Patent: Apr. 26, 2005

(54) DOUBLE-UNLOCKABLE LOCK STRUCTURE FOR BINDING STRAP

(76) Inventor: Chun-Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/833,077

(22) Filed: Apr. 28, 2004

(30) Foreign Application Priority Data

Jan. 19, 2004 (TW) ..... 93201052 U

(51) Int. Cl.[7] ..... E05B 37/00; E05B 73/00

(52) U.S. Cl. ..... 70/18; 70/58; 70/69; 70/284; 70/285

(58) Field of Search ..... 70/18, 21, 58, 70/69, 284, 285, 312, DIG. 63

(56) References Cited

U.S. PATENT DOCUMENTS 4,912,950 A * 4/1990 Crowle ..... 70/58
5,117,663 A * 6/1992 Ida ..... 70/64
5,193,368 A * 3/1993 Ling ..... 70/30
5,517,836 A * 5/1996 Hong ..... 70/30
5,692,403 A * 12/1997 Ling ..... 70/312
6,016,675 A * 1/2000 Te ..... 70/312
6,189,348 B1 * 2/2001 Huang ..... 70/18
6,684,667 B2 * 2/2004 Young ..... 70/18

* cited by examiner

*Primary Examiner*—Lloyd A. Gall
(74) *Attorney, Agent, or Firm*—Troxell Law Office, PLLC

(57) ABSTRACT

A double-unlockable lock structure for binding strap, including a latch seat, a numeral lock module, a latch cover and a button member. A lower latch hook is disposed on one side of the latch seat and drivable by a key-driven lock core. The other side of the latch seat is pivotally connected with the latch cover. The numeral lock module is disposed on the latch cover and has multiple numeral wheels exposed and shown to outer side through numeral wheel windows of the latch cover. The button member extends into the latch seat and is slidably connected under the latch cover. The button member has an upper latch hook for hooking the lower latch hook to keep the latch cover closed on the latch cover in a locked state. When the numeral wheels are turned to a correct unlocking number, a stop board is disengaged from the button member, whereby the upper latch hook of the button member can be unlatched from the lower latch hook of the latch seat to unlock the latch cover. Also, when a key is inserted to drive the lock core, the lower latch hook is pushed and unlatched from the upper latch hook so as to unlock the latch cover.

18 Claims, 5 Drawing Sheets

5B

5A

DOUBLE-UNLOCKABLE LOCK STRUCTURE FOR BINDING STRAP

BACKGROUND OF THE INVENTION

The present invention is related to a double-unlockable lock structure for binding strap, and more particularly to a lock device which includes a latch cover and a latch seat. The latch cover and the latch seat respectively have an upper latch hook and a lower latch hook latched with each other to lock the latch cover with the latch seat. The upper and lower latch hooks can be unlatched to unlock the latch cover from the latch seat by means of turning numeral wheels or using a key to drive an independent lock core.

A large-size trunk itself has a lock device. In addition, when transferred or stored, a strap, canvas belt or nylon rope is often used to bind the trunk. Two ends of the strap are connected with a key-driven lock or numeral lock to further lock the trunk.

The conventional locks can be divided into key-driven type and keyfree type according to the unlocking manner. With respect to the key-driven type lock, when a user travels in a foreign country, in the case that the user misses the key, it will be very inconvenient for the user to unlock the trunk. With respect to the keyfree lock such as a numeral lock, the above problem is avoided. However, the numeral lock has complicated structure and numerous parts and is inconvenient to operate. Therefore, the numeral lock is not suitable for the binding strap. Accordingly, it is tried by the applicant to develop a binding strap-used lock device combining characteristics of both key-driven type and keyfree type locks to facilitate use of the lock.

SUMMARY OF THE INVENTION

It is therefore a primary object of the present invention to provide a double-unlockable lock structure for binding strap. The lock structure includes a latch seat, a numeral lock module, a latch cover and a button member. A lower latch hook is disposed on one side of the latch seat and drivable by a key-driven lock core. The other side of the latch seat is pivotally connected with the latch cover. The numeral lock module is disposed in the latch cover and has multiple numeral wheels. The button member extends into the latch seat and is slidably connected under the latch cover. The button member has an upper latch hook. In normal state, the upper latch hook hooks the lower latch hook to keep the latch cover closed on the latch cover in a locked state. Each numeral wheel is drivingly connected with one numeral wheel sleeve. A stop board is pivotally connected under the numeral lock module. When turning the numeral wheels, the stop board is driven by the numeral wheel sleeves to engage with or disengage from the button member. When the stop board is disengaged from the button member, the upper latch hook of the button member can be unlatched from the lower latch hook of the latch seat to unlock the latch cover. Also, when a key is inserted to drive the lock core, the lower latch hook is pushed and unlatched from the upper latch hook so as to unlock the latch cover. Accordingly, the lock structure can be double locked/unlocked by means of both of the numeral lock module and the key.

The present invention can be best understood through the following description and accompanying drawings wherein:

BRIEF DESCRIPTION OF THE DRAWINGS

FIG. 5A is a sectional view taken along line A—A of FIG. 5;

FIG. 5B is a sectional view taken along line B—B of FIG. 5;

DETAILED DESCRIPTION OF THE PREFERRED EMBODIMENTS

Figure 1:
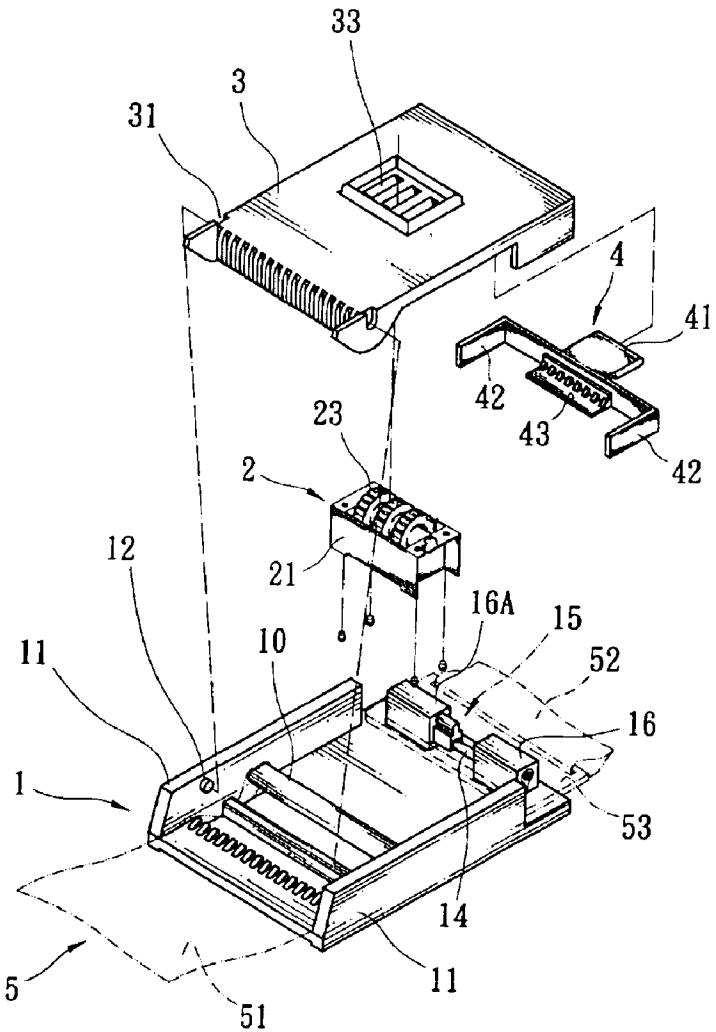
FIG. 1 is a perspective exploded view of the present invention.
Figure 2A:
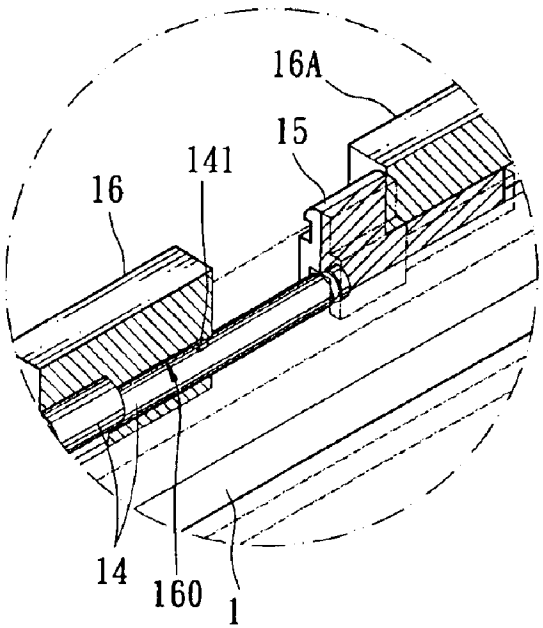
FIG. 2A is an enlarged view of circled area A of FIG. 2.
Figure 2:
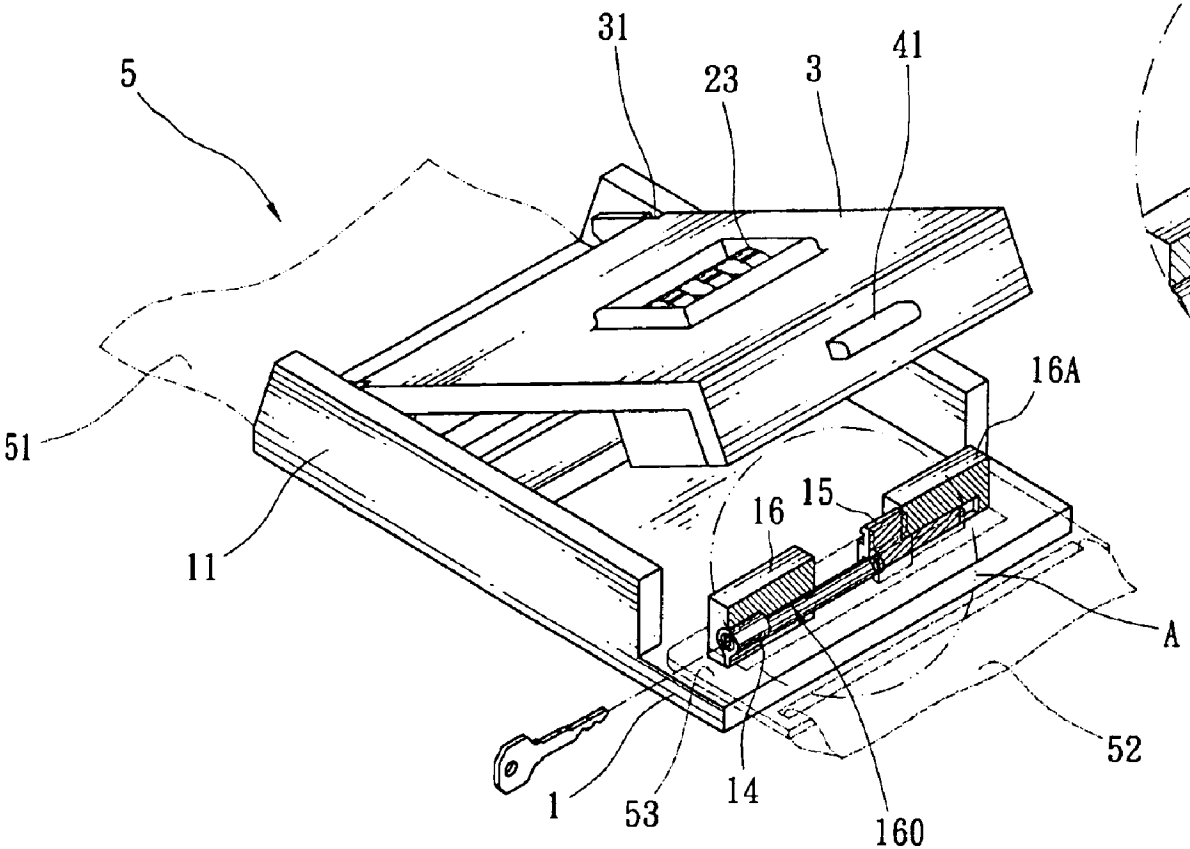
FIG. 2 is a perspective assembled view of the present invention.
Figure 3:
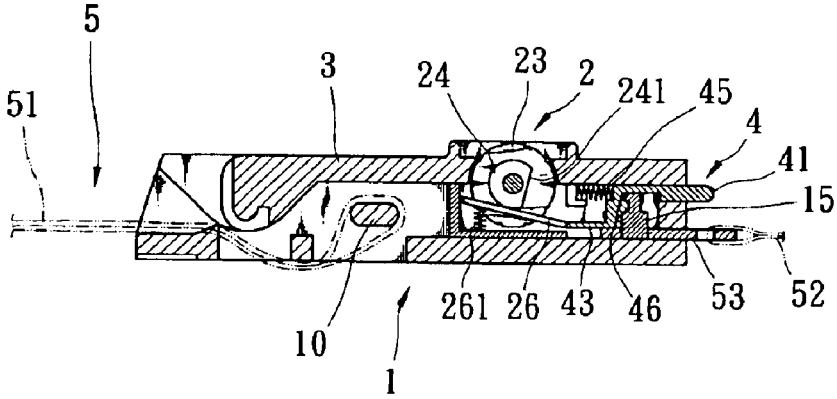
FIG. 3 is a side sectional assembled view of the present invention in a locked state.

Please refer to FIGS. 1, 2 and 3. The present invention includes a latch seat 1, a numeral lock module 2, a latch cover 3 and a button member 4. Two sides of the latch seat 1 have projecting sidewalls 11 defining a receiving space. A binding strap rack 10 is transversely disposed in the middle of the receiving space. A fixed end 51 of the binding strap 5 is fixedly tied on the rack 10. A pin shaft 12 projects from inner wall face of each sidewall 11. In addition, two projecting latch hook seats 16, 16A are disposed on front edge of the latch seat 1. A latched end 52 of the binding strap 5 has a latched head 53 formed with latch hole in which the latch hook seats 16, 16A are fitted. A displacement range is formed near or between the latch hook seats 16, 16A for receiving a lower latch hook 15. A key-driven module is transversely disposed on one side of the latch hook seats 16, 16A. A key-driven lock core 14 extends through a lock core hole 160 into the displacement range for driving the lower latch hook 15. The numeral lock module 2 includes a module frame 21 in which a wheel shaft is disposed. Multiple numeral wheels 23 are pivotally connected on the wheel shaft. Multiple numeral wheel sleeves 24 drivingly connected with the numeral wheels 23 are pivotally connected on the wheel shaft 22. The circumference of each numeral wheel sleeve 24 is formed with a plane cut face 241. A stop board 26 is pivotally connected under the module frame 21. A resilient member 261 is disposed under the stop board 26 for upward resiliently pushing the stop board 26, whereby the stop board 26 keeps attaching to lower side of the numeral wheel sleeves 24. Two opposite outer sides of one end of the latch cover 3 are respectively formed with two pin shaft dents 31 in which the pin shafts 12 of the latch seat 1 are pivotally connected. The other end of the latch cover 3 is formed with a through hole (not shown). A top section of the latch cover 3 is formed with multiple numeral wheel windows 33. When the numeral lock module 2 is connected under the latch cover 3, the numeral wheels 23 are exposed and shown to outer side through the windows 33. The button member 4 includes a pair of sideboards 42 which extend to form a U-shape. A press board 41 outward extends from the button member 4 between the sideboards 42. An inner extension section 43 inward extends from the button member 4. A resilient member 45 is compressed between the latch seat 1 and the button member 4. In normal state, the button member 4 tends to slide forward to engage with the front end of the latch cover 3, whereby the press board 41 outward protrudes from the latch cover 3 through the through hole thereof. The inner extension section 43 extends to one side of the numeral lock module 2. In a locked state, the rear end of the stop board 26 of the numeral lock module 2 just stops the inner extension section 43 from being inward pushed. The middle section of the button member 4 is formed with an upper latch hook 46 projecting to the lower latch hook 15. In normal state, the upper latch hook 46 is latched with the lower latch hook 15 of the latch seat 1. Accordingly, the latch cover 3 is kept closed and locked on the latch seat 1. Therefore, the latch head 53 of the binding strap 5 is restricted from unlatching from the latch hook seats 16, 16A of the latch seat 1 to achieve a locking effect.

Figure 4:
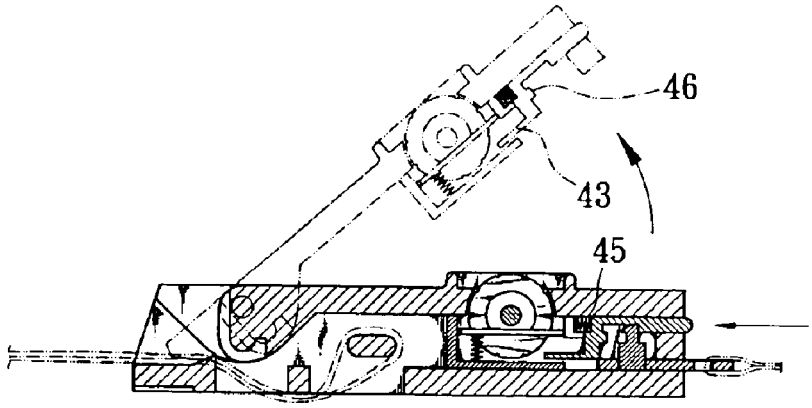
FIG. 4 is a side sectional assembled view of the present invention, in which the latch cover is unlocked by means of the numeral wheels.

FIG. 4 shows the unlocking operation by means of the numeral wheels. When the numeral wheels 23 are turned to a preset correct (number) position, the plane cut faces 241 of the respective numeral wheel sleeves 24 are just flush with the top face of the stop board 26. At this time, the stop board 26 can be biased away from the position where the stop board 26 is engaged with the inner extension section 43. Under such circumstance, the press board 41 can be pressed toward inner side of the latch cover 3 to compress the resilient member 45. Accordingly, the upper latch hook 46 of the button member 4 is unlatched from the lower latch hook 15 of the latch seat 1. At this time, the latch cover 3 can be pivotally turned upward about the pin shafts 12, permitting the latch head 53 of the binding strap 5 to be taken out from the latch hook seats 16, 16A to unlock the binding strap 5.

Figure 6:
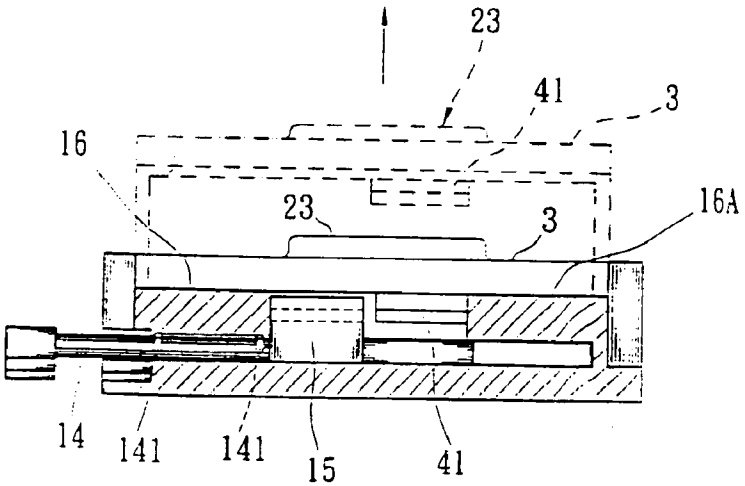
FIG. 6 is a sectional view showing that the present invention is unlocked by a key in a second stage.
Figure 5:
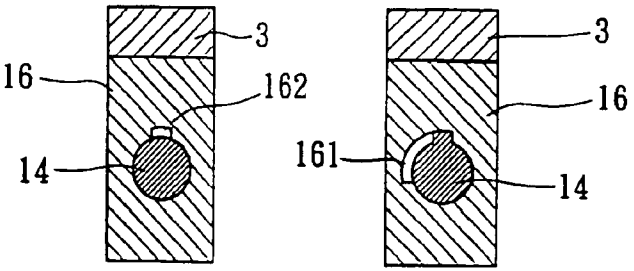
FIG. 5 is a sectional view showing that the present invention is unlocked by a key in a first stage.
Figure 5:
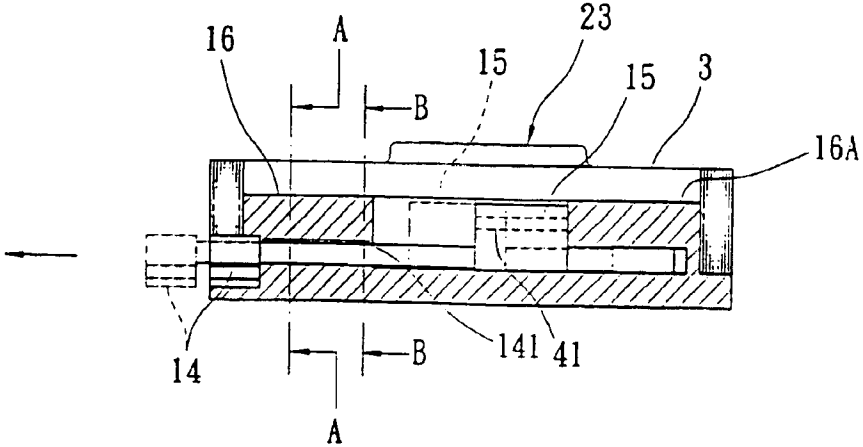

FIGS. 5 and 6 show the unlocking operation by means of the key. Also referring to FIGS. 5A and 5B, the lock core 14 is received in the lock core hole 160 transversely passing through the center of the latch hook seat 16. One end section of the lock core hole 160 is formed with a sector notch 161. A channel 162 extends from the sector notch 161 to the other end. An erect projecting block 141 is disposed on the middle section of the lock core 14. When the projecting block 141 is turned within the sector notch 161 to a position where the projecting block 141 is nonaligned from the channel 162, the lock core 14 cannot be pulled outward. In natural state, the upper latch hook 46 of the button member 4 is resiliently pushed by the resilient member 45 to keep hooking with the lower latch hook 15. At this time, the latch head 53 of the latched end 52 of the binding strap 5 is pressed by the latch cover 3 in a locked state. When a key is inserted to drive and turn the lock core 14, the projecting block 141 is aligned with the channel 162 in an unlocked position. Then the key is outward pulled to drive the lock core 14 to slide out of the lock core hole 160 of the latch hook seat 16. (The projecting block 141 is slid within the channel 162.) At this time, the lower latch hook 15 is driven to transversely displace and unlatch from the upper latch hook 46. Accordingly, the latch cover 3 can be turned upward to unlocked the binding strap 5.

Figure 8:
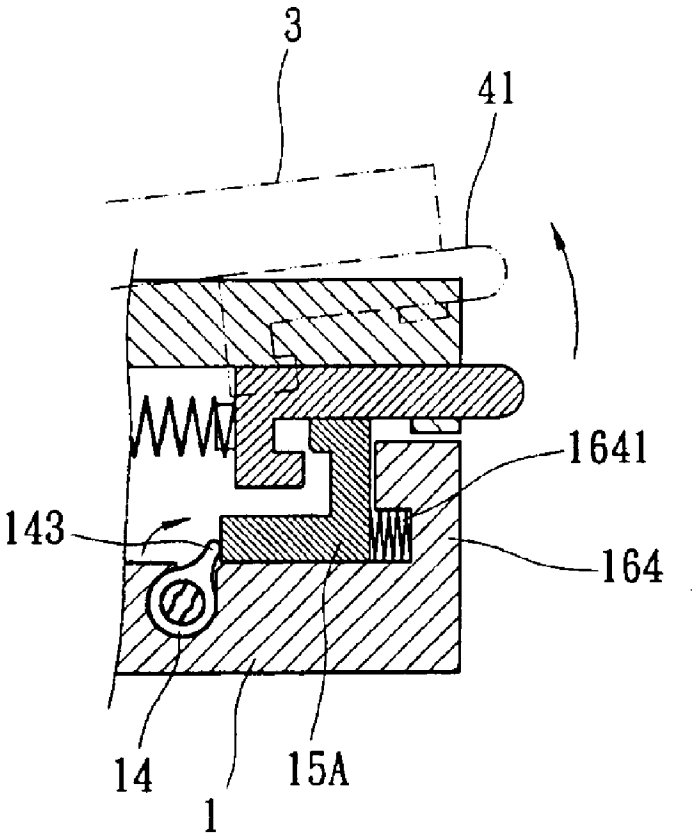
FIG. 8 is a sectional view of the other embodiment of the present invention, which is unlocked by a key.
Figure 7:
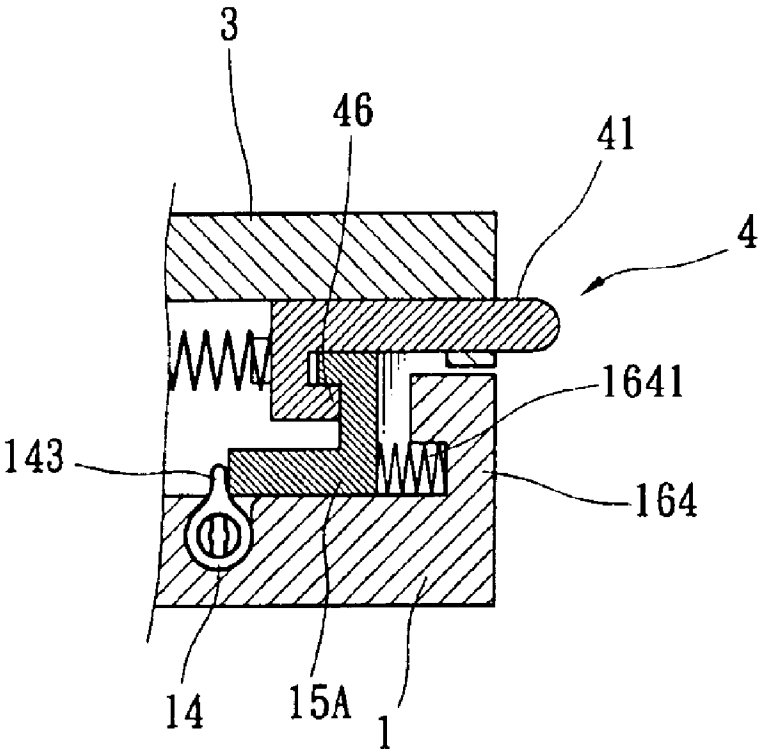
FIG. 7 is a sectional view of another embodiment of the present invention in a locked state.

FIGS. 7 and 8 show a second embodiment of the present invention. The lower latch hook 15A is disposed in the displacement range between the latch hook seats 16, 16A. The inner side of the lower latch hook 15A abuts against a projecting block 143 formed on the circumference of a lock core 14. A resilient member 1641 is compressed between outer side of the lower latch hook 15A and a stop section 164 projecting from the latch seat 1. The resilient member 1641 serves to resiliently push the lower latch hook 15A to keep the lower latch hook 15A tightly hooking with the upper latch hook 46 in a locked state, whereby the latch cover 3 cannot be opened. When a key is inserted to drive the lock core 14 and turn the projecting block 143, the lower latch hook 15A is pushed outward to unlatch from the upper latch hook 46 (with the resilient member 1641 compressed). Accordingly, the latch cover 3 can be turned upward into an unlocked state.

According to the above arrangement, the double-unlockable lock structure for binding strap of the present invention can be unlocked by means of numeral wheels or a key. Therefore, the use of the lock device is facilitated.

The above embodiments are only used to illustrate the present invention, not intended to limit the scope thereof. Many modifications of the above embodiments can be made without departing from the spirit of the present invention.

What is claimed is:

1. A double-unlockable lock structure for binding strap, comprising:

a latch seat having a receiving space and a binding strap disposed in the receiving space, one end of the binding strap being fixedly tied on a rack, projecting latch hook seats being disposed at one end of the latch seat, the other end of the binding strap having a latched head in which the latch hook seats are fitted, a displacement range being formed near the latch hook seats for receiving a lower latch hook drivingly connected with a lock core;

a latch cover, one end of the latch cover being pivotally disposed on the latch seat, the other end of the latch cover being a free end, whereby the latch cover can be turned up about the pivoted end, the latch cover being formed with numeral wheel windows;

a numeral lock module including a wheel shaft, several numeral wheels being pivotally connected on the wheel shaft and exposed and shown to outer side through the windows of the latch cover;

a button member disposed at the free end of the latch cover, the button member having an inner extension section extending from the button member toward inner side of the latch cover and a press board extending from the button member toward outer side of the latch cover, the button member being slidably connected under the latch cover, whereby the inner extension section extends to a position near the numeral lock module which controls the inner extension section to decide whether the button member can be pushed or not, a projecting upper latch hook being disposed near the free end of the button member, whereby in normal state, the upper latch hook hooks the lower latch hook to keep the latch cover closed on the latch seat in a locked state; and a key-driven module including a key-driven lock core, when the key drives the lock core, the lower latch hook is driven to latch with or unlatch from the upper latch hook.

2. The double-unlockable lock structure for binding strap as claimed in claim 1, wherein a lock core hole transversely passes through the center of the latch hook seat, the lock core extending through the lock core hole to drivingly connect with the lower latch hook, whereby after a key is inserted to turn the lock core, the lock core can be pulled outward to transversely move the lower latch hook and unlatch the lower latch hook from the upper latch hook so as to unlock the latch cover.

3. The double-unlockable lock structure for binding strap as claimed in claim 1, wherein a projecting block is formed on a circumference of inner end of the lock core, whereby when the lock core is turned, the projecting block is rotated along with the lock core to abut against and push the lower latch hook to displace, a resilient member being compressed between the lower latch hook and the latch seat, the resilient member serving to resiliently push the lower latch hook to keep the lower latch hook hooking with the upper latch hook in a natural state, whereby when a key is inserted to drive the lock core and turn the projecting block, the lower latch hook is pushed outward to unlatch from the upper latch hook so as to unlock the latch cover.

4. The double-unlockable lock structure for binding strap as claimed in claim 1, wherein a pin shaft projects from inner wall face of each sidewall of one end of the latch seat, two opposite outer sides of one end of the latch cover being respectively formed with two pin shaft dents, whereby the pin shafts of the latch seat are pivotally fitted in the pin shaft dents to pivotally connect the latch cover with the latch seat.

5. The double-unlockable lock structure for binding strap as claimed in claim 2, wherein a pin shaft projects from inner wall face of each sidewall of one end of the latch seat, two opposite outer sides of one end of the latch cover being respectively formed with two pin shaft dents, whereby the pin shafts of the latch seat are pivotally fitted in the pin shaft dents to pivotally connect the latch cover with the latch seat.

6. The double-unlockable lock structure for binding strap as claimed in claim 3, wherein a pin shaft projects from inner wall face of each sidewall of one end of the latch seat, two opposite outer sides of one end of the latch cover being respectively formed with two pin shaft dents, whereby the pin shafts of the latch seat are pivotally fitted in the pin shaft dents to pivotally connect the latch cover with the latch seat.

7. The double-unlockable lock structure for binding strap as claimed in claim 1, wherein a resilient member is disposed beside the inner extension section of the button member and compressed between the latch cover seat and the button member, whereby resilient member keeps the press board of the button member outward protruding from the latch cover and ensures that the upper latch hook of the button member hooks the lower latch hook of the latch seat.

8. The double-unlockable lock structure for binding strap as claimed in claim 2, wherein a resilient member is disposed beside the inner extension section of the button member and compressed between the latch cover and the button member, whereby resilient member keeps the press board of the button member outward protruding from the latch cover and ensures that the upper latch hook of the button member hooks the lower latch hook of the latch seat.

9. The double-unlockable lock structure for binding strap as claimed in claim 3, wherein a resilient member is disposed beside the inner extension section of the button member and compressed between the latch cover and the button member, whereby resilient member keeps the press board of the button member outward protruding from the latch cover and ensures that the upper latch hook of the button member hooks the lower latch hook of the latch seat.

10. The double-unlockable lock structure for binding strap as claimed in claim 1, wherein the button member includes a pair of sideboards which extend to form a U-shape, the press board extending from the middle of the button member between the sideboards toward outer side of the latch cover.

11. The double-unlockable lock structure for binding strap as claimed in claim 2, wherein the button member includes a pair of sideboards which extend to form a U-shape, the press board extending from the middle of the button member between the sideboards toward outer side of the latch cover.

12. The double-unlockable lock structure for binding strap as claimed in claim 3, wherein the button member includes a pair of sideboards which extend to form a U-shape, the press board extending from the middle of the button member between the sideboards toward outer side of the latch cover.

13. The double-unlockable lock structure for binding strap as claimed in claim 10, wherein each numeral wheel is drivingly connected with one numeral wheel sleeve, a circumference of each numeral wheel sleeve being formed with a plane cut face, a stop board being pivotally connected under a module frame of the numeral lock module, a resilient member being disposed under the stop board for resiliently pushing the stop board and keeping the stop board attaching to the numeral wheel sleeves, whereby when the numeral wheels are turned to a correct position, the plane cut faces of the respective numeral wheel sleeves attach to the stop board, permitting the stop board to be biased and disengaged from the inner extension section of the button member, whereby the press board can be pressed to compress a resilient member and unlatch the upper latch hook of the button member from the lower latch hook of the latch seat.

14. The double-unlockable lock structure for binding strap as claimed in claim 11, wherein each numeral wheel is drivingly connected with one numeral wheel sleeve, a circumference of each numeral wheel sleeve being formed with a plane cut face, a stop board being pivotally connected under a module frame of the numeral lock module, a resilient member being disposed under the stop board for resiliently pushing the stop board and keeping the stop board attaching to the numeral wheel sleeves, whereby when the numeral wheels are turned to a correct position, the plane cut faces of the respective numeral wheel sleeves attach to the stop board, permitting the stop board to be biased and disengaged from the inner extension sect ion of the button member, whereby the press board can be pressed to compress the resilient member and unlatch the upper latch hook of the button member from the lower latch hook of the latch seat.

15. The double-unlockable lock structure for binding strap as claimed in claim 12, wherein each numeral wheel is drivingly connected with one numeral wheel sleeve, a circumference of each numeral wheel sleeve being formed with a plane cut face, a stop board being pivotally connected under a module frame of the numeral lock module, a resilient member being disposed under the stop board for resiliently pushing the stop board and keeping the stop board attaching to the numeral wheel sleeves, whereby when the numeral wheels are turned to a correct (unlocking number) position, the plane cut faces of the respective numeral wheel sleeves attach to the stop board, permitting the stop board to be biased and disengaged from the inner extension section of the button member, whereby the press board can be pressed to compress the resilient member and unlatch the upper latch hook of the button member from the lower latch hook of the latch seat.

16. The double-unlockable lock structure for binding strap as claimed in claim 1, wherein each numeral wheel is drivingly connected with one numeral wheel sleeve, a circumference of each numeral wheel sleeve being formed with a plane cut face, a stop board being pivotally connected under a module frame of the numeral lock module, a resilient member being disposed under the stop board for resiliently pushing the stop board and keeping the stop board attaching to the numeral wheel sleeves, whereby when the numeral wheels are turned to a correct (unlocking number) position, the plane cut faces of the respective numeral wheel sleeves attach to the stop board, permitting the stop board to be biased and disengaged from the inner extension section of the button member, whereby the press board can be pressed to compress the resilient member and unlatch the upper latch hook of the button member from the lower latch hook of the latch seat.

17. The double-unlockable lock structure for binding strap as claimed in claim 2, wherein each numeral wheel is drivingly connected with one numeral wheel sleeve, a circumference of each numeral wheel sleeve being formed with a plane cut face, a stop board being pivotally connected under a module frame of the numeral lock module, a resilient member being disposed under the stop board for resiliently pushing the stop board and keeping the stop board attaching to the numeral wheel sleeves, whereby when the numeral wheels are turned to a correct (unlocking number) position, the plane cut faces of the respective numeral wheel sleeves attach to the stop board, permitting the stop board to be biased and disengaged from the inner extension section of the button member, whereby the press board can be pressed to compress a resilient member and unlatch the upper latch hook of the button member from the lower latch hook of the latch seat.

18. The double-unlockable lock structure for binding strap as claimed in claim 3, wherein each numeral wheel is drivingly connected with one numeral wheel sleeve, a circumference of each numeral wheel sleeve being formed with a plane cut face, a stop board being pivotally connected under a module frame of the numeral lock module, a resilient member being disposed under the stop board for resiliently pushing the stop board and keeping the stop board attaching to the numeral wheel sleeves, whereby when the numeral wheels are turned to a correct position, the plane cut faces of the respective numeral wheel sleeves attach to the stop board, permitting the stop board to be biased and disengaged from the inner extension section of the button member, whereby the press board can be pressed to compress a resilient member and unlatch the upper latch hook of the button member from the lower latch hook of the latch seat.

* * * * *